US007896975B2

(12) United States Patent
Chung et al.

(10) Patent No.: US 7,896,975 B2
(45) Date of Patent: Mar. 1, 2011

(54) SUMP ASSEMBLY AND DISH WASHER USING THE SAME

(75) Inventors: Yang Hoon Chung, Incheon-si (KR); Young Hwan Park, Seoul (KR); Si Moon Jeon, Seoul (KR); Tae Hee Lee, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 525 days.

(21) Appl. No.: 11/263,824

(22) Filed: Nov. 2, 2005

(65) Prior Publication Data

US 2006/0249184 A1 Nov. 9, 2006

(30) Foreign Application Priority Data

May 6, 2005 (KR) ..... 10-2005-0037916

(51) Int. Cl.
*B08B 3/00* (2006.01)

(52) U.S. Cl. ..... 134/56 D; 134/58 D; 134/109

(58) Field of Classification Search ..... 134/56 D, 134/109

See application file for complete search history.

(56) References Cited

U.S. PATENT DOCUMENTS 5,433,232 A * 7/1995 Young, Jr. ..... 134/111
6,418,943 B1 * 7/2002 Miller ..... 134/104.1
2004/0159337 A1 * 8/2004 Johnson et al. ..... 134/18

FOREIGN PATENT DOCUMENTS

KR 10-2000-0009780 A 2/2000

* cited by examiner

*Primary Examiner* — Michael Barr
*Assistant Examiner* — Jason Y. Ko
(74) *Attorney, Agent, or Firm* — Birch, Stewart, Kolasch & Birch, LLP

(57) ABSTRACT

The present invention is to provide a sump assembly which enables leaked washing water therein to be circulated smoothly without remaining therein, and a dishwasher using the same cleanly and sanitarily. For this, the present invention includes a sump housing for holding washing water; an impeller housing secured to the sump housing for placing an impeller pumping the washing water therein; a filter housing provided on an upper portion of the impeller housing for placing a filter filtering the washing water therein; and a connection device for making a lower portion of the filter housing in communication with the sump housing. Owing to the above configuration, the dishwasher may be used cleanly and sanitarily, resulting in enhancing washing efficiency and endurance of a product.

20 Claims, 4 Drawing Sheets

SUMP ASSEMBLY AND DISH WASHER USING THE SAME

This application claims the benefit of the Patent Korean Application No. P2005-0037916, filed on May 6, 2005, which is hereby incorporated by reference as if fully set forth herein.

BACKGROUND OF THE INVENTION

1. Field of the Invention

The present invention relates to a dishwasher, and more particularly, to a sump assembly which holds washing water in the dishwasher and supplies the washing water to spray nozzles, and a dishwasher using the same.

2. Discussion of the Related Art

Generally, a dishwasher is an electric home appliance which washes dishes by spraying high pressure washing water to the dishes through spray nozzles.

Referring to FIG. 1, a related art dishwasher will be described.

As shown in FIG. 1, a conventional dishwasher comprises a tub 1 having space for washing therein, a plurality of dish racks 6, 7 provided in the tub 1, spray nozzles 4, 5 for spraying the washing water to the dish racks, and a sump assembly 10 for holding the washing water and supplying it to the spray nozzles 4, 5.

When operating the dishwasher, clean washing water supplied from an outside of the dishwasher is stored in the sump assembly 10. The sump assembly 10 supplies the washing water stored therein to the spray nozzles 4, 5 through connection pipes 2, 3. Then, the spray nozzles 4, 5 spray the washing water to the dishes on the dish racks 6, 7 and washes the dishes. After that, contaminated washing water which has washed the dishes is dropped down to a lower side of the tub 1, and re-stored in the sump assembly 10.

As washing time passes, the washing water is getting more contaminated. Thus, when the washing water is severely contaminated, the sump assembly 10 drains the contaminated washing water through a drain hose 9 and receives fresh washing water. On the other hand, when the washing water is not contaminated severely, the sump assembly 10 re-supplies the washing water dropped from the tub 1 to the spray nozzles 4, 5.

However, the conventional sump assembly 10 according to the related art has a problem that the washing water supplied to the spray nozzles 4, 5 may be leaked inside of the sump assembly 10.

That is, in the process of supplying the washing water pumped in the sump assembly 10 to a lower spray nozzle 5, the rotation of the lower spray nozzle 5 and so on may generate a vibration in a connection portion of the components including the sump assembly 10, thereby causing a leakage of the washing water inside of the sump assembly 10.

Accordingly, foreign substances remaining and containing in the leaked washing water may be left and accumulated, thereby causing unsanitary conditions such as ill-smell and increasing bacteria.

Also, due to the water leakage in the portion where a heater is installed, there are problems of deteriorating washing efficiency as well as having a bad influence on endurance of the components around the heater.

SUMMARY OF THE INVENTION

Accordingly, the present invention is directed to a sump assembly and a dishwasher using the same that substantially obviates one or more problems due to limitations and disadvantages of the related art.

An object of the present invention is to provide a sump assembly which enables leaked washing water therein to be circulated smoothly without remaining therein, and a dishwasher using the same cleanly and sanitarily.

Another object of the present invention is to provide a sump assembly which prevents the washing water from being leaked inside thereof, resulting in enhancing washing efficiency and endurance of a product, and a dishwasher using the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a sump assembly comprises a sump housing for holding washing water; an impeller housing secured to the sump housing for placing an impeller pumping the washing water therein; a filter housing provided in an upper portion of the impeller housing for placing a filter filtering the washing water therein; and a connection device for making a lower portion of the filter housing in communication with the sump housing.

A soil chamber housing provided inside of the sump housing is further comprised, having a flow passage for guiding the pumped washing water into the spray nozzles.

The connection device may comprise an inlet hole formed in the filter housing; an outlet hole formed in the soil chamber housing; and a guide pipe for connecting the inlet hole and the outlet hole. Also, the guide pipe may be formed avoided toward an outside of the impeller housing.

The guide pipe comprises a first guide pipe extending downwardly from the inlet hole of the filter housing; and a second guide pipe extending upwardly from the outlet of the flow passage housing for forming a flow passage together with the first guide pipe.

The guide pipe may be formed extending downwardly from the inlet hole of the filtering housing for passing through the outlet hole.

A bottom around the inlet hole of the filter housing may slope downward to the inlet hole.

In another aspect of the present invention, a dishwasher comprises a body having a predetermined space for washing therein; a spray unit provided inside of the body for spraying the washing water to dishes; and a sump assembly for holding the washing water as well as pumping the washing water to the spray unit. The sump assembly comprises a sump housing for holding the washing water; an impeller housing secured to the sump housing for placing an impeller pumping the washing water therein; a filter housing provided in an upper portion of the impeller housing for placing a filter filtering the washing water therein; and a connection device for making a lower portion of the filter housing in communication with the sump housing.

The sump assembly may further comprise a soil chamber housing provided inside of the sump housing, having a flow passage for guiding pumped washing water into spray nozzles.

The connection device may comprise an inlet hole formed in the filer housing; an outlet hole formed in the soil chamber housing; and a guide pipe for connecting the inlet hole and the outlet hole. Also, the guide pipe may be formed avoided toward an outside of the impeller housing.

The guide pipe may comprise a first guide pipe extending downwardly from the inlet hole of the filter housing; and a second guide pipe extending upwardly from the outlet hole of the flow passage housing for forming a flow passage together with the first guide pipe.

The guide pipe may be formed extending downwardly from the inlet hole of the filtering housing for passing through the outlet hole.

A bottom around the inlet hole of the filter housing may slope downward to the inlet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 3:
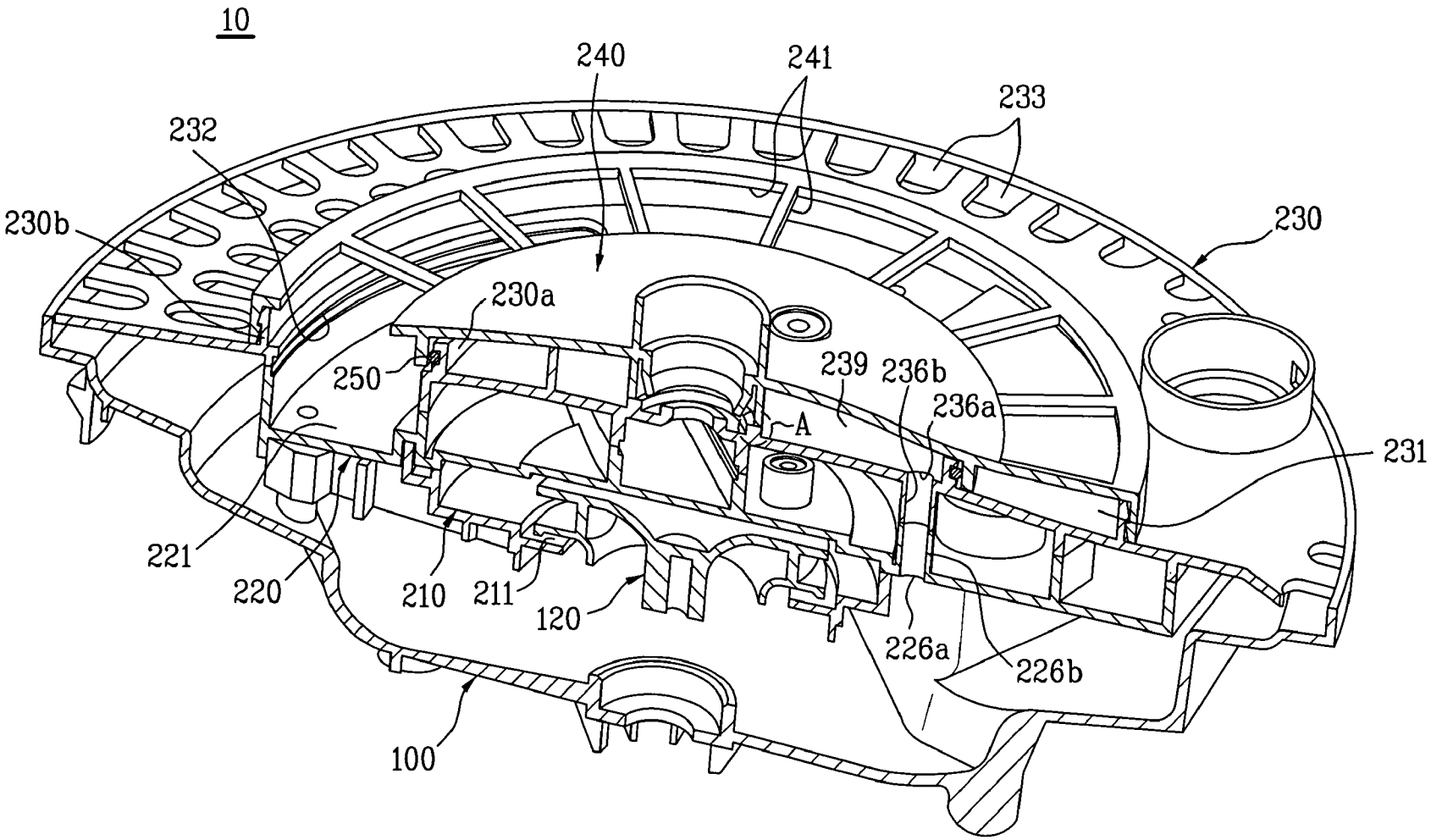
FIG. 3 illustrates a cut-away perspective view of a sump assembly according to a first embodiment of the present invention.

Referring to FIG. 3, in a sump assembly 10 according to the present invention a sump housing 100 is provided for holding washing water after receiving the washing water from an outside drain pipe. The sump housing 100 has a recess 150 at a center of a bottom for holding the washing water, and a water supply hole 151 in one side of the recess 150 for connecting a water supply pipe thereto. There is a heater (not shown) in the recess 150 for heating the washing water in the recess 150.

Figure 1:
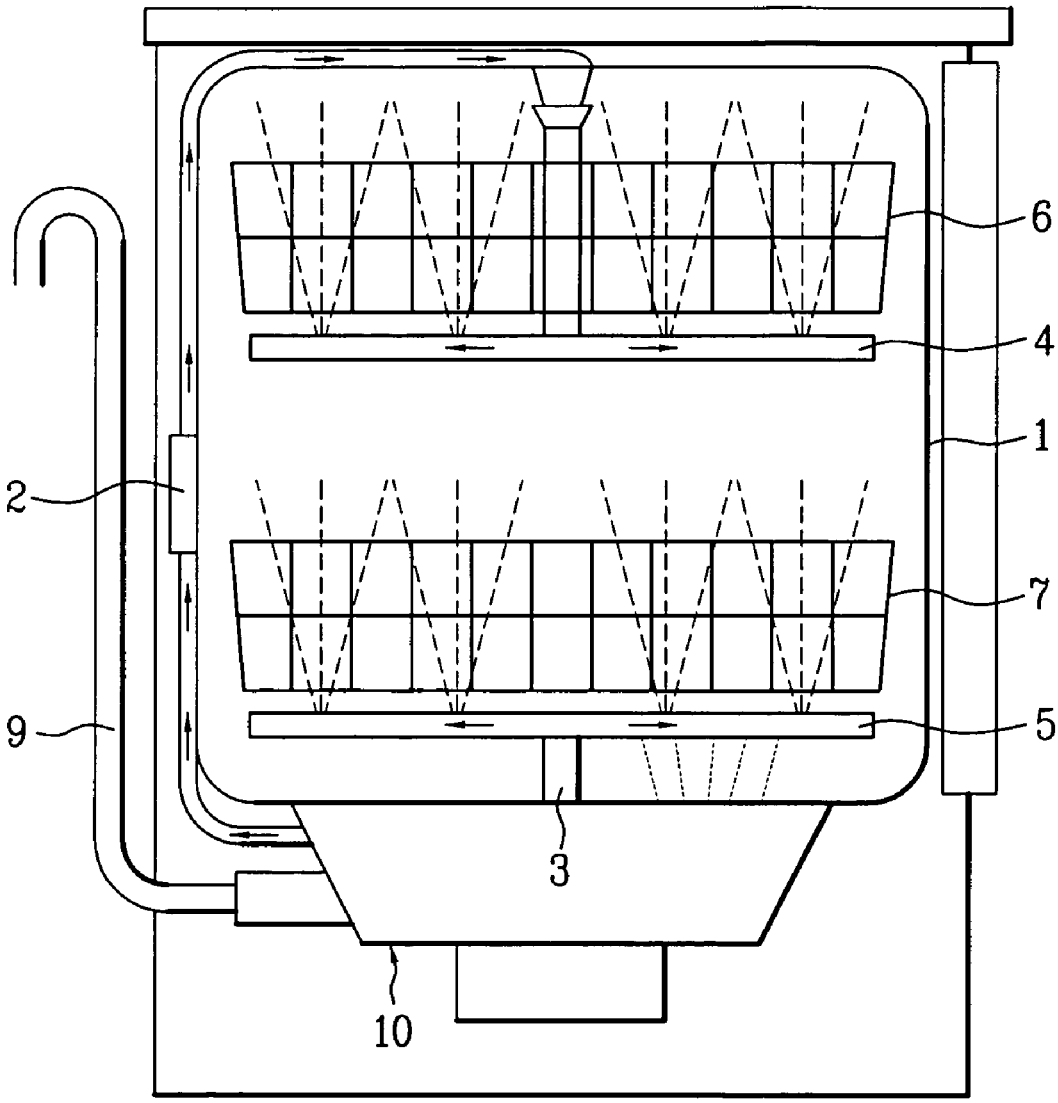
FIG. 1 illustrates a related art dishwasher schematically.
Figure 2:
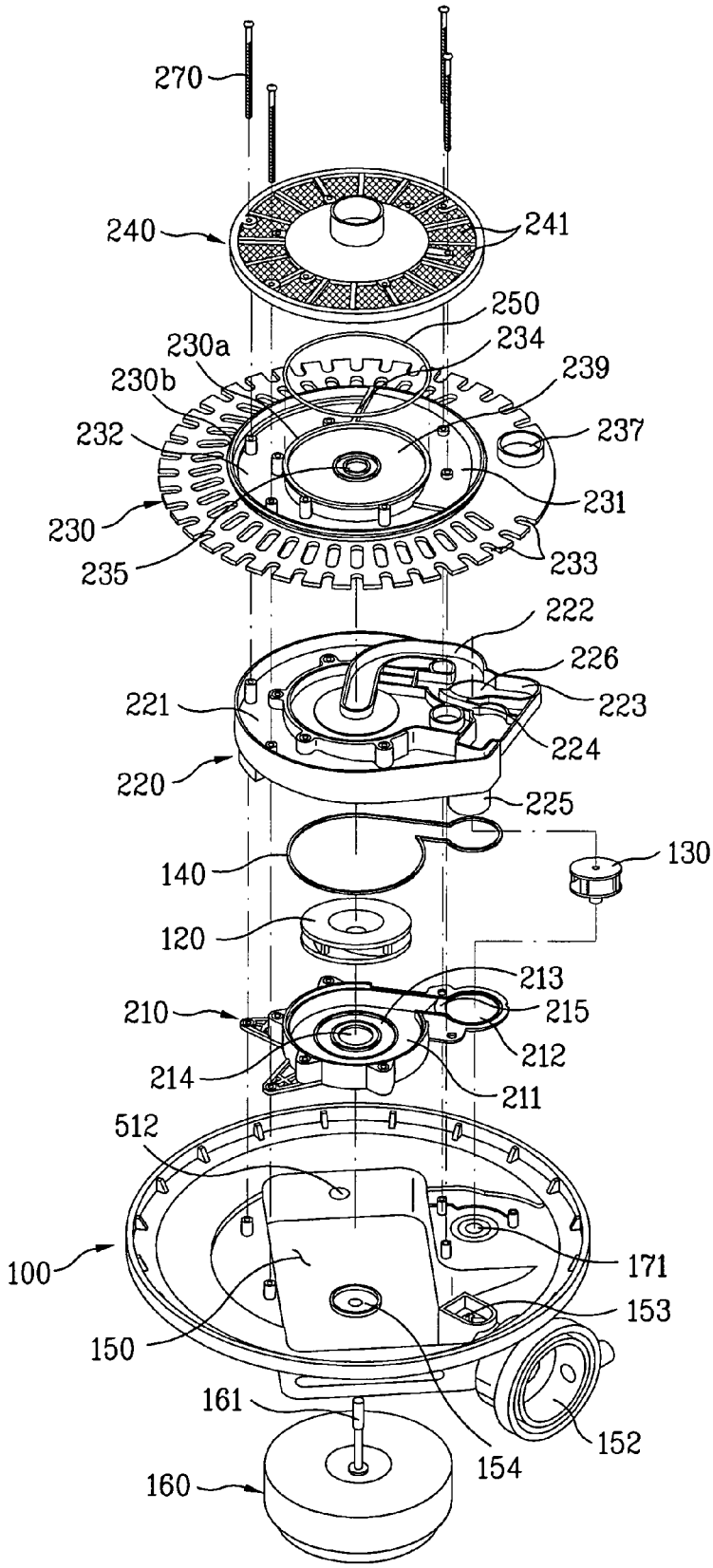
FIG. 2 illustrates an exploded perspective view of a sump assembly according to the present invention.

The sump housing 100 has a coupling portion 152 at one side for coupling a drain pump (not shown) thereto. As shown in FIG. 1, the coupling portion 152 is projected toward the recess 150, and the drain pump is mounted on an outside surface of the sump housing 100 so that an impeller 120 may be placed in the coupling portion 152. Therefore, upon putting the drain pump into operation, the washing water is discharged from the sump housing 100 and a soil chamber 221 to an outside through the drain hose.

A pump for pumping water stored in the sump housing 100 includes a motor 160, an impeller housing 210, and an impeller 120. As shown in FIG. 1, the motor 160 is mounted on the bottom of the sump housing 100, with a shaft 161 of the motor 160 passing through the hole 154 in the bottom of the recess 150.

The impeller 120 is coupled to the shaft 161. The impeller 120 draws washing water in an axial direction, and discharges the washing water in a radial direction. For this, the impeller 120 has an upper plate and a lower plate spaced apart as well as a plurality of blades between the upper plated and the lower plate.

As shown in FIG. 1, the impeller housing 210 is secured to an under side of the soil chamber housing 220 mounted on the sump housing 100, and surrounds the impeller 120. The impeller housing 210 has a recessed portion 213 at a center of bottom for placing the impeller 120 therein, and the recessed portion 213 has an inlet 214 for drawing the washing water in the sump housing 100. Therefore, once putting the pump into operation, the washing water in the sump housing 100 is introduced into the impeller 120 through the inlet 214.

A pumping flow passage 211 is formed along a circumference of the recessed portion 213 in the impeller housing 210, and an outlet 215 is formed in a circumferential surface of the impeller housing 210 for making the pumping flow passage 211 in communication with an outside of the impeller housing 210.

The outlet 215 at the end of the pumping flow passage 211 is tangential to an outside circumferential surface of the impeller housing 210. Also. The outlet 215 has a sloped surface to smoothly guide the washing water having passed through the pumping flow passage 211.

In the meantime, the sump housing 100 has the soil chamber housing 220 mounted thereon. The soil chamber housing 220 receives the washing water pumped by the pump and discharged through the outlet 215. The soil chamber housing 220 guides some of the washing water received therein to the spray nozzles of the dishwasher. The soil chamber housing 220 will be described in more detail.

The soil chamber housing 220 includes a valve receiving portion 226 in communication with the outlet 215.

The valve receiving portion 226 has a first guide flow passage 222 for supplying the washing water to a lower nozzle of the dishwasher, and a second guide flow passage 223 for supplying the washing water to an upper nozzle. The first guide flow passage 222 is formed over the soil chamber housing 220, extending from the valve receiving portion 226 to a center of the soil chamber housing 220. The second guide flow passage 223 is formed over the soil chamber housing 220, extending from the valve receiving portion 226 to an edge of the soil chamber housing 220. The first guide flow passage 222 and the second guide flow passage 223 are respectively connected to pipes connected to the lower nozzle and the upper nozzle.

A diverting valve 130 is provided in the valve receiving portion 226 for selectively guiding some of the washing water from the outlet 215 either to the first guide flow passage 222 or to the second guide flow passage 223. The diverting valve 130 is rotated by a motor (not shown) provided under the sump housing 100 separately. Therefore, a hole is formed in the sump housing 100 for having the shaft of the motor coupled to the diverting valve 130 pass it through. A recessed portion 171 is provided around the hole for receiving a lower end of the diverting valve 130.

A bypass 224 is provided over the soil chamber housing 220 connected thereto. The soil chamber 221 extends along a circumference of the soil chamber housing 220. A drain 225 is formed at the end of the soil chamber 221, connected to the second drain hole 153 in the sump housing 100.

Accordingly, some of the washing water pumped by the pump is introduced into the valve receiving portion 226 through the outlet 215, and supplied to the upper nozzle or the lower nozzle by the diverting valve 130. The rest of the washing water is introduced into the soil chamber 221 through the bypass 224. That is, as long as the pump is operated and the washing water in the sump housing 100 is at a regular level, a fixed rate of the washing water always flows to the soil chamber 221 through the bypass 224.

On the other hand, a filter housing 230 is mounted over the sump housing 100 having the soil chamber housing 220 connected thereto for covering an opened top of the sump housing 100.

The filter housing 230 is disposed on an upper surface of the soil chamber housing 220 with being stepped from a bottom of the fist soil chamber 221 in a predetermined height. Also, the filter housing 230 has a second soil chamber 231 in communication with the first soil chamber 221.

Meanwhile, there is a plurality of apertures 233 at a periphery of the filter housing 230. The apertures 233 guide the washing water fallen down after washing the dishes in the tub of the dishwasher to the sump housing 100.

There is a groove (not shown) on a lower side of the filter housing 230 for supporting an upper end of the diverting valve 130. At a center of the filter housing 230, there is a first communication hole 235 for making the lower nozzle and the first guide flow passage 222 in communication, and at a fist side edge of the filter housing 230 there is a second communication hole 237 for making the upper nozzle and the second guide flow passage 223 in communication.

In the mean time, the sump housing 100, the soil chamber housing 220 and the filter housing 230 are fastened securely with fastening members such as bolts.

On an upper surface of the filter housing 230, there is an arm holder 240 having a filter part 241 for covering each upper side of the first and the second soil chamber 221, 231.

The operation of the sump assembly according to the present invention will be described. When the dishwasher starts washing or rinsing, fresh water is introduced into the recess 150 in the sump housing 100 through the water supply hole 151. The washing water introduced into the recess 150 is heated by the heater (not shown). Once finishing the water supply, the motor 160 of the pump starts to pump up the washing water stored in the recess.

Hence, some of the pumped washing water is introduced into the valve receiving portion 226 through the outlet 215, and then guided either to the first guide flow passage 222 or to the second guide flow passage 223 by the diverting valve 130. The washing water guided to the first guide flow passage 222 is supplied to the lower nozzle through a connector 210, and the washing water guided to the second guide flow passage 223 is supplied to the upper nozzle through the second communication hole 237. The washing water supplied to the lower nozzle washes the dishes on the lower rack in the tub of the dishwasher, and the washing water supplied to the upper nozzle washes the dishes on the upper rack in the tub of the dishwasher.

The washing water and contaminants falls down after it washes the dishes and they are separated from the dishes. The contaminants and the washing water are re-introduced into the sump housing 100 through the apertures 233 along the circumferential surface of the filter housing 230, and then re-held in the recess 150. As described before, the washing water returned to the recess 150 contains much contaminant. Thus, the contaminant is pumped up by the pump together with the washing water.

In the mean time, the rest of the washing water pumped up by the impeller 120 is introduced into the bypass 224 through the hole 234. After that, the washing water is introduced from the bypass 224 into the soil chamber 221.

As time passes by, a water level of the soil chamber 221 becomes high and the washing water introduced into the soil chamber 221 overflows from the soil chamber 221. The overflowing washing water passes through the filter 241 and in succession the apertures 233 in the sump housing 100, and then introduced into the sump housing 100 again. However, of the contaminants introduced into the soil chamber 221, large ones are filtered at the filter 241, thereby accumulated in the soil chamber 221.

As described before, the washing water introduced into the soil chamber 221 via the bypass 224 is filtered by the filter 241, and supplied to the sump housing 100. The filtered washing water supplied to the sump housing 100 passes through the above steps again, and supplied to the spray nozzles again. Thus, the sump assembly 10 of the present invention supplies the washing water to the nozzles while filtering the washing water during washing or rinsing.

In case that the washing or rinsing time is finished, or the washing water is contaminated heavily, the drain pump (not shown) is put into operation. Hence, the washing water and contaminations in the soil chamber 221 and the recess 150 of the sump housing 100 are discharged to an outside of the dishwasher via the drain hose by the drain pump.

Referring to FIG. 3, a sump assembly 10 according to a first embodiment of the present invention will be described.

As shown in the first embodiment of the present invention, a connection device is provided for making a lower portion of the filter housing 230 and the sump housing 100 in communication. The connection device discharges washing water, leaked out of the washing water guided to a lower spray arm 5 through a flow passage of the soil chamber housing 220, to the sump housing 100.

The connection device includes an inlet hole 236*a* in the filter housing 230, an outlet hole 226*a* in the soil chamber housing 220, and a guide pipe 236*b*, 226*b* for connecting the inlet hole 236*a* with the outlet hole 236*b*.

The guide pipe 236*b*, 226*b* includes a first guide pipe 236*b* extending downwardly from the inlet hole 236*a* of the filter housing 230, and a second guide pipe 226*b* extending upwardly from the outlet hole 226*a* of the soil chamber housing 220, for forming a flow passage together with the first guide pipe 236*b*. At this time, the first guide pipe 236*b* and the second guide pipe 226*b* may be securely fastened so as to prevent the washing water from being leaked outside the guide pipe 236*b*, 226*b*.

On the other hand, a bottom around the inlet hole 236*b* of the filter housing 230 slopes downward to the inlet hole 236*a* for helping the leaked washing water introduced into the inlet hole 236*a* smoothly.

Also, the guide pipe 236*b*, 226*b* is avoided toward an outside of the impeller housing 210 for having the washing water into the filter housing 230 discharged to the sump housing 100 smoothly.

Therefore, through the connection device, the sump assembly 10 of the present invention may smoothly discharge the washing water leaked into an empty space 239 in the filter housing 230 through a fastening portion A between the arm holder 240 and the filter housing 230 according as the lower spray arm 5 is rotated.

That is, the washing water leaked into the empty space 239 of the filter housing 230 is introduced into the inlet hole 236*a* of the filter housing 230. Hence, after running in the first and the second connection pipe 236*a*, 226*a*, the washing water is discharged to an inside space of the sump housing 100 through the outlet hole 226*a* of the flow passage housing 220.

Therefore, according to the present invention, a more clean and hygienic sump assembly 10 may be provided, because the washing water leaked into the filter housing 230 is not accumulated but circulated smoothly.

Figure 4:
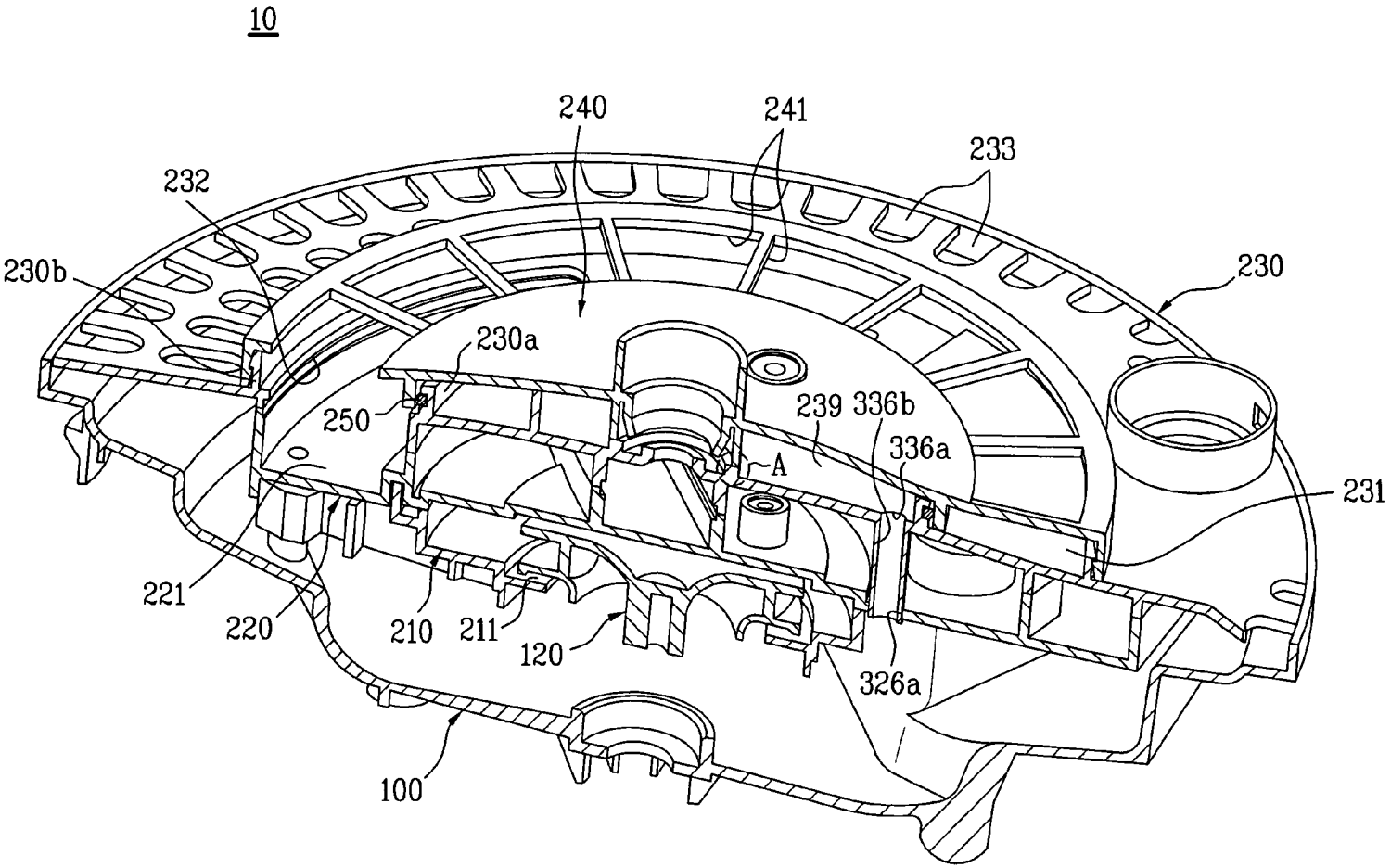
FIG. 4 illustrates a cut-away perspective view of a sump assembly according to another embodiment of the present invention.

Referring to FIG. 4, a sump assembly 10 according to another embodiment of the present invention will be described.

In this embodiment, there is a guide pipe 336*b* extending downwardly from an inlet hole 336*a* of the filter housing 230 so as to pass through an outlet hole 326*a*. That is, the connection device includes the inlet hole 336*b* in the filter housing 230, the outlet hole 326*b* in the flow passage housing 220, and a guide pipe 336*b* extending downwardly from the inlet hole 336*b* for passing through the outlet hole 326 in communication with the sump assembly 100.

Accordingly, unlike the first embodiment described before, the guide pipe 336*b* guiding leaked washing water is directly passing through the outlet hole 326*a*. The assembly efficiency of the filter housing 230 and the flow passage housing 220 can be enhanced, because the washing water leaked into the filter housing 230 is discharged to the sump 100 smoothly.

At this time, it is preferred but not necessary that a bottom of a space in an upper surface of the filter housing 230, where the washing water is leaked, may slope downward gradually from the washing water leaked portion to the inlet hole 336*a* for the leaked washing water's being introduced into the inlet hole 336*a* smoothly.

Also, there formed the outlet hole 326*a* of the flow passage housing 220 avoided toward an outside of the pump housing 210, so that the washing water leaked into the filter housing 230 may be discharged to the sump housing 100 smoothly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A sump assembly comprising:

a sump housing for holding washing water;

an impeller housing secured to the sump housing for placing an impeller pumping the washing water therein;

a filter housing provided on an upper portion of the impeller housing for placing a filter filtering the washing water therein;

a connection device for making a lower portion of the filter housing in fluid communication with the sump housing and introducing leaked washing water in the filter housing into the sump housing to discharge the leaked washing water; and a soil chamber housing provided in the sump housing, having a flow passage for guiding pumped washing water to spray nozzles, wherein the connection device comprises an inlet hole formed in the filter housing, an outlet hole formed in the soil chamber housing, and a guide pipe for connecting the inlet hole with the outlet hole, the guide pipe providing an unobstructed passage from the inlet hole to the outlet hole and wherein the guide pipe does not contact the impeller housing.

2. The sump assembly of claim 1, wherein the guide pipe comprises:

a first guide pipe extending downwardly from the inlet hole of the filter housing; and a second guide pipe extending upwardly from the outlet hole of the soil chamber housing for forming a flow passage with the first guide pipe together.

3. The sump assembly of claim 1, wherein the guide pipe is formed extending downwardly from the inlet hole of the filter housing and passes through the outlet hole.

4. The sump assembly of claim 1, wherein a bottom around the inlet hole of the filter housing slopes downward to the inlet hole.

5. A dishwasher comprising:

a body having a predetermined space for washing therein;

a spray unit provided in the body for spraying washing water to dishes; and a sump assembly for holding the washing water as well as pumping the washing water to the spray unit, comprising:

a sump housing for holding the washing water;

an impeller housing secured to the sump housing for placing an impeller pumping the washing water therein;

a filter housing provided on an upper portion of the impeller housing for placing a filter filtering the washing water therein;

a connection device for making a lower portion of the filter housing in fluid communication with the sump housing and introducing leaked washing water in the filter housing into the sump housing to discharge the leaked washing water; and a soil chamber housing provided in the sump housing, having a flow passage for guiding pumped washing water to spray nozzles, wherein the connection device comprises an inlet hole formed in the filter housing, an outlet hole formed in the soil chamber housing, and a guide pipe for connecting the inlet hole with the outlet, the guide pipe providing an unobstructed passage from the inlet hole to the outlet hole and wherein the guide pipe does not contact the impeller housing.

6. The dishwasher of claim 5, wherein the guide pipe comprises:

a first guide pipe extending downwardly from the inlet hole of the filter housing; and a second guide pipe extending upwardly from the outlet hole of the soil chamber housing for forming a flow passage with the first guide pipe together.

7. The dishwasher of claim 5, wherein the guide pipe is formed extending downwardly from the inlet hole of the filter housing and passes through the outlet hole.

8. The dishwasher of claim 5, wherein a bottom around the inlet hole of the filter housing slopes downward to the inlet hole.

9. The sump assembly of claim 1, wherein the guide pipe is tubular shaped.

10. The sump assembly of claim 2, wherein the first guide pipe and the second guide pipe are aligned along a same axis.

11. The sump assembly of claim 10, wherein the same axis is spaced laterally from an impeller axis of rotation defined by the impeller housing.

12. The sump assembly of claim 1, wherein the guide pipe forms a passage from an upper side of the filter housing to a lower side of the soil chamber housing.

13. The sump assembly of claim 1, wherein the inlet hole is an aperture penetrating through the filter housing, and the outlet hole is an aperture penetrating through the soil chamber housing.

14. The sump assembly of claim 13, wherein the inlet hole is a cylindrical aperture, and the outlet hole is a cylindrical aperture.

15. The dishwasher of claim 5, wherein the guide pipe is tubular shaped.

16. The dishwasher of claim 6, wherein the first guide pipe and the second guide pipe are aligned along a same axis.

17. The dishwasher of claim 16, wherein the same axis is spaced laterally from an impeller axis of rotation defined by the impeller housing.

18. The dishwasher of claim 5, wherein the guide pipe forms a passage from an upper side of the filter housing to a lower side of the soil chamber housing.

19. The dishwasher of claim 5, wherein the inlet hole is an aperture penetrating through the filter housing, and the outlet hole is an aperture penetrating through the soil chamber housing.

20. The dishwasher of claim 19, wherein the inlet hole is a cylindrical aperture, and the outlet hole is a cylindrical aperture.

* * * * *